United States Patent [19]

Päiväläinen et al.

[11] Patent Number: 4,591,005

[45] Date of Patent: May 27, 1986

[54] DRILL ROD OPENING DEVICE FOR SECTIONAL-ROD DRILLING EQUIPMENT

[75] Inventors: Ossi Päiväläinen; Leo Häkkinen, both of Tampere, Finland

[73] Assignee: Oy Tampella AB, Tampere, Finland

[21] Appl. No.: 500,626

[22] Filed: Jun. 3, 1983

[30] Foreign Application Priority Data

Jul. 7, 1982 [FI] Finland ..... 822416

[51] Int. Cl.[4] ..... E21B 3/00

[52] U.S. Cl. ..... 173/164; 166/77.5; 175/85

[58] Field of Search ..... 173/164; 175/52, 85; 166/77.5

[56] References Cited

U.S. PATENT DOCUMENTS

| | | | |
|---|---|---|---|
| 2,809,014 | 10/1957 | Lawrence et al. | 173/164 |
| 3,291,225 | 12/1966 | Foran | 173/164 |
| 3,741,322 | 6/1973 | Wolters | 175/85 X |
| 3,964,552 | 6/1976 | Slator | 173/164 |
| 3,986,569 | 10/1976 | Hilding | 173/164 X |

FOREIGN PATENT DOCUMENTS

| | | | |
|---|---|---|---|
| 652931 | 9/1964 | Belgium | 173/164 |
| 737614 | 6/1980 | U.S.S.R. | 173/164 |

*Primary Examiner*—E. R. Kazenske

*Assistant Examiner*—Willmon Fridie, Jr.

*Attorney, Agent, or Firm*—Ladas & Parry

[57] ABSTRACT

A drill rod opening device for sectional-rod drilling equipment, which opening device (5) comprises a coupling frame (9), which can be coupled to a drilling machine (1) of the drilling equipment and which is provided with a through hole (10) for a drill rod to be threaded into a drill rod shank of the drilling machine, and grasping device (13) mounted in the coupling frame. The grasping device are displaceable to a locking position, in which the grasping device extend into the hole in the coupling frame and, lock the rod to the coupling frame, and to a detaching position, in which the grasping device permit movement of the rod in relation to the coupling frame. The coupling frame is provided to be coupled to a front cover (4) of the drilling machine rotably but substantially axially undisplaceably in relation to the drill rod shank. The grasping device are provided to lock the drill rod in the locking position axially undisplaceably to the coupling frame. The coupling frame (9) preferably comprises an internal annular bearing (12) coaxial with the through hole (10) for journalling the coupling frame rotably but axially undisplaceably to a cylindrical support element (25) provided in the front cover (4) of the drilling machine (1).

6 Claims, 6 Drawing Figures

DRILL ROD OPENING DEVICE FOR SECTIONAL-ROD DRILLING EQUIPMENT

Figure 1:
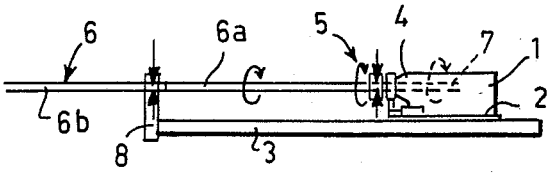

The present invention is concerned with a drill rod opening device for sectional-rod drilling equipment, said opening device comprising a coupling frame which can be coupled to a drilling machine of the drilling equipment and which is provided with a through hole for a drill rod to be threaded into a drill rod shank of the drilling machine, and grasping means mounted in the coupling frame, said grasping means being displaceable to a locking position in which the grasping means extend into said hole in the coupling frame and lock the rod to the coupling frame, and to a detaching position, in which the grasping means permit movement of the rod in relation to the coupling frame.

In sectional-rod drilling, for joining and disassembling of individual drill rods, particular opening devices are utilized, which are used in cooperation with so-called retaining guides. The purpose of the opening device is to lock the drill rod threaded into the drill rod shank non-rotable in relation to the shank when the opposite end of the drill rod must be threaded apart from the next drill rod, retained by the retaining guide, by means of a rotating movement of the drill rod shank, and, correspondingly, to be uncoupled from the drill rod when the end of the drill rod positioned towards the drill rod shank must be threaded apart from the shank or threaded into the shank by means of a rotating movement of the drill rod shank.

From U.S. Pat. No. 3,851,714 an opening device is previously known in which a piston is fitted in an axial bore provided in the end of the drill rod shank facing towards the drilling machine, from which piston a coupling pin projects towards the free front end of the drill rod shank. The outer surface of the coupling pin is provided with longitudinal grooves and the pin slides in a guide sleeve mounted stationarily in the bore in the drill rod shank, the inside surface of the sleeve being provided with corresponding grooves. The piston is displaceable by means of a pressure medium against a spring effect so that the coupling pin slides in the guide sleeve between a projecting locking position and a retracted detaching position. The front end of the drill rod shank is provided with a threading for fastening a drill rod by threading. At the end of the drill rod, there is an axial bore whose inside surface is provided with grooves similar to those of the coupling pin. When the drill rod is intended to be locked non-rotable in relation to the drill rod shank, the coupling pin is pushed into its locking position, wherein the grooves of the locking pin have been pushed into engagement with the grooves of the drill rod. When the movement of rotation between the drill rod and the drill rod shank is intended to be permitted, the coupling pin is returned to its detaching position.

The construction according to said U.S. patent is based thereon that the drill rod and the drill rod shank can be fixed non-rotably in relation to each other by locking the drill rod non-rotably to a coupling element, which is attached non-rotably to the drill rod shank. An opening device constructed in accordance with such a principle, however, involves certain remarkable drawbacks. The coupling pin including the piston and spring must be rotated constantly together with the drill rod shank, which consumes energy. The end of the drill rod must be provided with grooves for the coupling pin, which is laborious in view of the production. The pushing of the coupling pin into engagement with the grooves of the drill rod is unreliable, because the grooves of the drill rod must be positioned precisely in alignment with the grooves of the coupling pin, which requires a precise angular position of the drill rod in relation to the drill rod shank. Dirty operating conditions may hamper a reliable coupling operation of the coupling pin. The construction additionally makes the arrangement of the flushing more difficult, because the coupling pin blocks the central bore in the drill rod. Nor is such an opening device suitable for a percussion drilling machine.

From GB Pat. No. 1,302,109 an opening device is previously known which comprises a cylindrical coupling frame having a through hole for a drill rod, said coupling frame being rigidly fixed to a ring-shaped shaft revolving along with the drill rod shank. The coupling frame is provided with three evenly spaced eccentric wheels mounted in the frame around the through hole. The eccentric wheels are fitted to revolve freely in relation to the frame around shafts parallel to the axis of the hole. The turning of the eccentric wheels between a locking position extending into the hole and a retracted detaching position takes place by means of the effect of the mass inertia acting upon the eccentric wheels when the coupling frame is rotated along with the drill rod shank. The eccentric wheels are provided with projecting cams which are, in the locking position, pressed in the direction of the circumference of the drill rod against the outer surface of the drill rod and prevent rotation of the drill rod in relation to the coupling frame and therefore also in relation to the drill rod shank.

The opening device according to said GB patent is also based thereon that the drill rod shank and the drill rod can be attached to each other non-rotably by locking the drill rod non-rotably to a coupling element, which is attached non-rotably in relation to the drill rod shank. As already mentioned above, in an opening device constructed in accordance with such a principle, the coupling frame including the eccentric wheels must be rotated constantly together with the drill rod shank. Dirty operating conditions, wear of the eccentric wheels and a more complicated control system reduce the locking reliability of the eccentric wheels operating by means of the principle of mass inertia.

The object of the present invention is to provide an opening device which is based on a different principle of operation and which therefore avoids the above drawbacks. This object is achieved by means of an opening device in accordance with the invention, which is characterized in that the coupling frame is provided to be coupled to the drilling machine rotably but essentially axially undisplaceably in relation to the drill rod shank and that the grasping means lock in the locking position the drill rod axially undisplaceably to the coupling frame.

The opening device in accordance with the invention is based on the idea that, since the drill rod and the drill rod shank are in threaded engagement with each other and the rotation of the drill rod in relation to the drill rod shank therefore always also requires an axial movement of the drill rod in relation to the drill rod shank, the drill rod and the drill rod shank can be locked non-rotably in relation to each other by preventing axial movement of the drill rod in relation to the drill rod shank. Therefore the coupling frame of the opening device does not have to be mounted non-rotably in relation to the drill rod shank, i.e. so that it always rotates together with the shank, but the coupling frame can be mounted so that it remains stationary in spite of rotation of the drill rod shank when the opening device is in the detaching position. Owing to this, the mass of the opening device does not have to be rotated uselessly. By providing the grasping means to lock the drill rod axially undisplaceably to the coupling frame, it is possible, in a simple way, to make the grasping means power-driven, whereby their movements are positive and reliable.

The grasping means may be eccentric wheels, which are rotably mounted in the coupling frame and which are in engagement with displacement means by which the eccentric wheels can be rotated between said locking position and said detaching position. In such a case it is advantageous that the axes of the eccentric wheels are positioned perpendicularly to a plane or planes passing through the axis of rotation of the coupling frame. The position of the axes of the eccentric wheels perpendicularly to the axis of rotation of the coupling frame permits a construction of smaller outside dimensions than if the axes were parallel to the axis of rotation. The circumferences of the eccentric wheels may be shaped in accordance with the roundness of the drill rod, which improves the grasping quality of the eccentric wheels as well as their wear resistance and reliability of operation.

Figure 2:
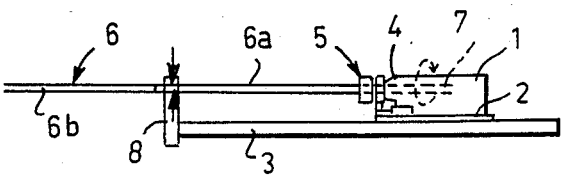
Figure 5:
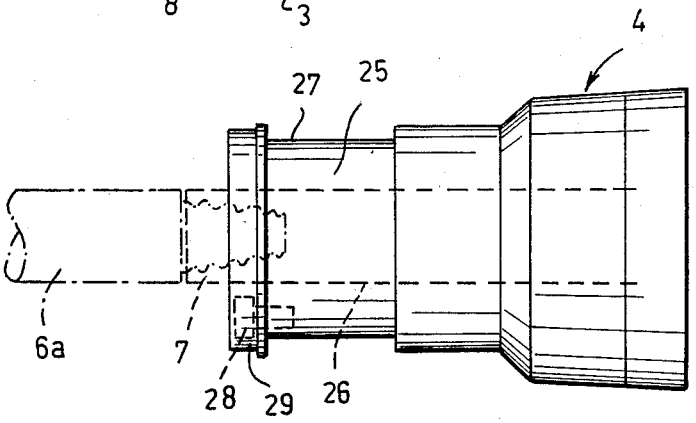
Figure 6:
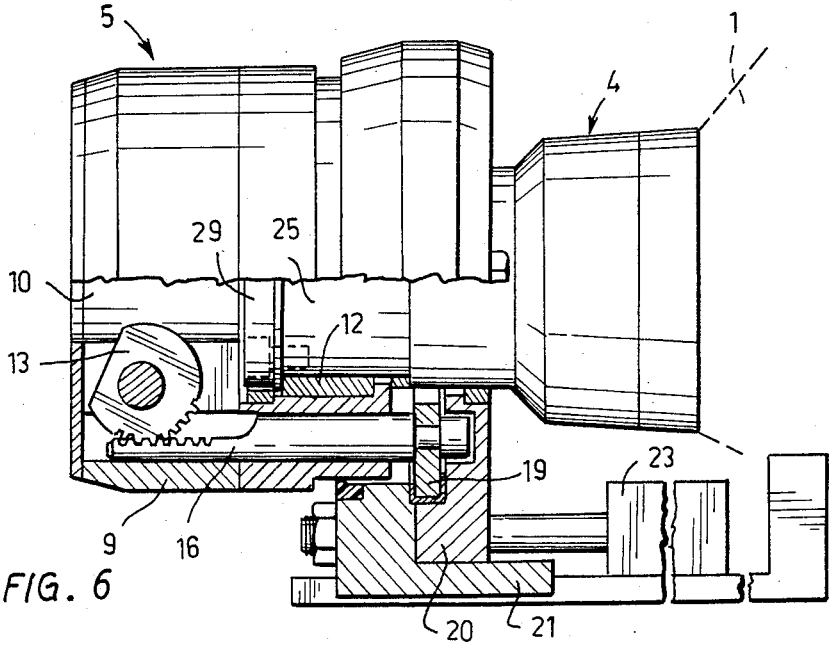
Figure 3:
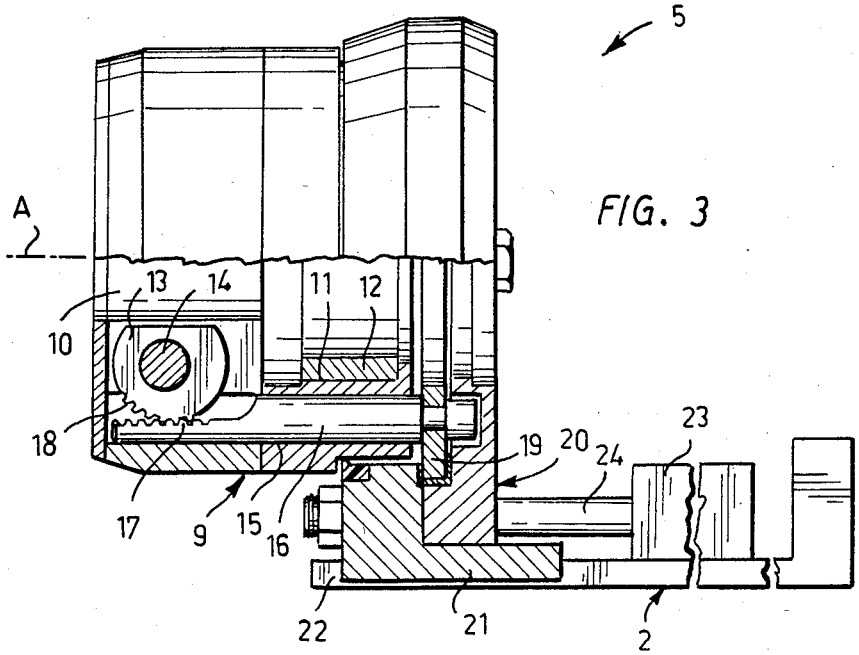
Figure 4:
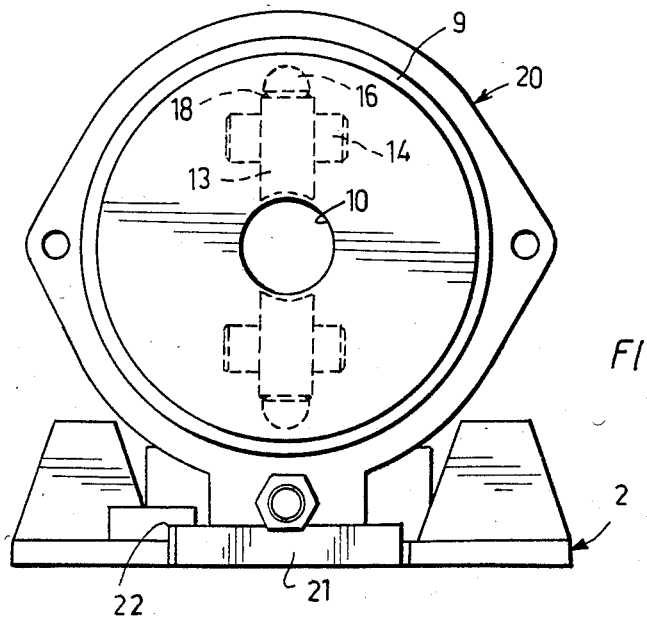

The invention will be described in more detail below with reference to the attached drawings, wherein FIGS. 1 and 2 are schematical side views of a drilling equipment provided with an opening device in accordance with the invention in two different stages of detaching of a drill rod, FIG. 3 is an enlarged view of a partial axial section of a preferred embodiment of an opening device in accordance with the invention, FIG. 4 is an end view of the opening device, FIG. 5 is a side view of a drilling machine front cover designed for the opening device, and FIG. 6 shows the opening device and the front cover of the drilling machine as fitted together, in the locking position of the grasping means.

In FIGS. 1 and 2 of the drawings, reference numeral 1 denotes a drilling machine for a drilling equipment, which drilling machine is mounted on a sledge 2 to move along a feeding beam 3. The front cover 4 of the drilling machine supports an opening device 5 in accordance with the invention. The drilling equipment 6 consists of subsequent drill rods 6*a*, 6*b* threaded together. The rod positioned nearest the drilling machine is threaded into a rotable drill rod shank 7 belonging to the drilling machine. At the opposite end of the feeding beam, there is a retaining guide 8 for the drill rod.

The opening device 5 (FIG. 3) comprises a cylindrical coupling frame 9, which is provided with a central through hole 10 and with a bearing housing 11 which is coaxial with said hole and is provided with an annular slide bearing 12. Two eccentric wheels 13 are mounted rotably in the coupling frame by means of shafts 14 at diametrically opposite sides of the hole 10. The shafts 14 are positioned perpendicularly to a plane passing through the axis A of the coupling frame.

Moreover, bores 15 parallel to the axis A are formed in the coupling frame outside the eccentric wheels, into which bores shifting rods 16 are slidingly journalled. At one end of the shifting rods there are tooth racks 17, which are in engagement with toothed rims 18 on the eccentric wheels. The opposite ends of the shifting rods are attached to a support ring 19, which is rotably mounted to a shifting ring 20 coaxial with the coupling frame. The bottom portion of the shifting ring is provided with a slide 21, which glides along guides 22 provided on the sledge 2. The slide is attached to the piston rod 24 of a hydraulic cylinder 23 attached to the sledge.

FIG. 5 shows the front cover 4 (flange of the flushing chamber), which is earlier known per se to which some modifications required by the opening device described above have been made.

The front cover comprises a cylindrical support element 25 having a central through hole 26, through which the drill rod shank 7 of the drilling machine extends when the front cover is mounted stationarily to the frame of the drilling machine 1. The outer surface of the support element forms a bearing surface 27, which is dimensioned so as to receive the slide bearing 12 of the opening device when the coupling frame is pushed onto the front cover.

An annular retaining flange 29 is fixed by means of bolts 28 to the end of the support element of the front cover. The flange is pressed against the end of the slide bearing 12 and prevents axial sliding of the coupling frame on the support element.

The opening device operates as follows:

The coupling frame of the opening device is mounted rotably but axially undisplaceably supported by the front cover of the drilling machine. The drill rod 6*a* extends through the coupling frame and is fixed to the drill rod shank 7 of the drilling machine by threading. The drill rod shank is, in a way in itself known, axially undisplaceable in relation to the front cover—with the exception of a possibly slight axial play necessary in a percussion drilling machine—and rotable by means of a rotation mechanism not shown. The front cover is attached to the frame of the drilling machine, which frame is attached axially undisplaceably and non-rotably to the sledge 2.

When the slide 21 is shifted by means of the hydraulic cylinder 23 towards the cylinder, the slide pulls the support ring 19 away from the coupling frame 9 by means of the shifting ring 20, whereby the shifting rods 16 move in their bores and their racks rotate the eccentric wheels anticlockwise in FIG. 6 into the locking position, in which the wheels project into the hole 10 in the coupling frame and engage the drill rod 6*a* positioned in the hole and lock axially undisplaceably and non-rotably to the coupling frame. Any tendency of the drill rod to move axially outwards in the coupling frame causes an ever stronger wedging of the drill rod between the eccentric wheels.

When the drill rod shank is rotated in a direction tending to thread the drill rod apart from the drill rod shank, such a threading apart is prevented by the fact that the slide bearing 12 of the coupling frame is pressed against the retaining flange 28 of the front cover and prevents axial movement of the coupling frame in relation to the front cover and, consequently, also in relation to the drill rod shank. The consequence is that the drill rod is locked non-rotably to the drill rod shank. This locking is taken advantage of in order to thread the drill rod 6*a* apart from the drill rod 6*b*, which has been locked non-rotably by means of the retaining guide 8 (FIG. 1).

When the drill rod 6*a* is intended to be threaded into or out of the drill rod shank, the drill rod is locked non-rotably by means of the retaining guide and the eccentric wheels of the opening device are kept in the detaching position, whereby the coupling frame remains stationary in position while the drill rod shank rotates (FIG. 2). The situation is the same during drilling, at which time the retaining guide just guides the drill rod 6a.

The drawings and the related description are only intended to illustrate the idea of the invention. In its details, the device in accordance with the invention may vary within the scope of the claims. Instead of toothed shifting rods, it is possible to use various lever, chain, wedge and equivalent mechanisms or cogbelts, elements expanding under compression etc. Instead of eccentric wheels, it is also possible to use other kinds of grasping means, e.g. wedges, jaws, or equivalent. Instead of an annular slide bearing, it is possible to use some other suitable bearing.

What is claimed is:

1. A drill rod opening device (5) for sectional rod drilling equipment, comprising a coupling frame (9) coupled to a drilling machine (1) of the drilling equipment, said coupling frame (9) having a hole (10) going there through, said hole being adapted to receive a drill rod (6a), said drill rod being threaded into a drill rod shank (7) of the drilling machine (1), grasping means (13) being mounted in the coupling frame, said grasping means having locking and unlocking position, in said locking position said grasping means being extended into said hole of the coupling frame, in said locking position said rod being locked by said grasping means to said coupling frame, in said unlocking position of said grasping means said rod being allowed to move in relation to the coupling means, the coupling frame (9) being coupled to the drilling machine (1) rotatably and substantially undisplaceably in relation to the drill rod shank (7) and said grasping means (13) being adapted to lock the drill rod (6a) in the locking position axially undisplaceably to the coupling frame, the grasping means consists of eccentric wheels, which are mounted rotatably to the coupling frame and which are in engagement with sliding means, by which the eccentric wheels can be rotated between said locking position and said unlocking position.

2. An opening device as claimed in claim 1, wherein the shafts (14) of the eccentric wheels are positioned perpendicularly to a plane or planes passing through the axis of rotation (A) of the coupling frame (9).

3. An opening device as claimed in claim 2, wherein the shifting means (16) are provided with tooth racks (16), which are slideably mounted in the coupling frame in parallel with the axis of rotation (A) of the frame, that the racks are coupled to a drive gear (23, 24) for axial displacement of the racks, and that the eccentric wheels are provided with toothings (18) in engagement with said racks.

4. An opening device as claimed in claim 3, wherein the racks (17) are attached to a support ring (19) perpendicular to the axis of rotation (A) of the coupling frame (9) and that the support ring is mounted rotably in relation to the coupling frame in an axially moving shifting ring (20), which is mounted non-rotably but axially movably on a sledge (2), and that the drive gear (23,24) is attached to said sledge.

5. An opening device as claimed in claim 1, wherein two said eccentric wheels are journalled to the coupling frame (9) at diametrically opposite sides of the through hole (10).

6. An opening device as claimed in claim 1, wherein the coupling frame (9) comprises an internal annular bearing (12) coaxial with the through hole (10) for journalling the coupling frame rotatably but axially undisplaceably to a front cover (4) of the drilling machine (1), the front cover (4) being provided with a cylindrical support element (25) having an outer mantle forming a bearing surface (27) for said annular bearing (12) of the coupling frame (9), and that the support element is provided with an annular retaining flange (29), against which the annular bearing of the coupling frame is pressed axially so as to lock the coupling frame axially undisplaceably to the front cover.

* * * * *